US010096956B1

(12) United States Patent
Wu et al.

(10) Patent No.: US 10,096,956 B1
(45) Date of Patent: Oct. 9, 2018

(54) ELECTRICAL CONNECTOR

(71) Applicant: Cheng Uei Precision Industry Co., Ltd., New Taipei (TW)

(72) Inventors: Yun Wu, Dong-Guan (CN); Chao-Yong Ye, Dong-Guan (CN); Kai-Hsiang Chang, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/803,772

(22) Filed: Nov. 4, 2017

(51) Int. Cl.

| | |
|---|---|
| ***H01R 13/52*** | (2006.01) |
| ***H01R 13/6581*** | (2011.01) |
| ***H01R 24/60*** | (2011.01) |
| *H01R 107/00* | (2006.01) |

(52) U.S. Cl.
CPC ..... *H01R 24/60* (2013.01); *H01R 13/521* (2013.01); *H01R 13/6581* (2013.01); *H01R 2107/00* (2013.01)

(58) Field of Classification Search
CPC .. H01R 24/60; H01R 13/521; H01R 13/6581; H01R 2107/00
See application file for complete search history.

(56) References Cited

U.S. PATENT DOCUMENTS

| | | | | |
|---|---|---|---|---|
| 9,525,244 | B1 * | 12/2016 | Hsu | H01R 13/6585 |
| 9,667,001 | B2 * | 5/2017 | Zhao | H01R 13/6581 |
| 9,847,614 | B1 * | 12/2017 | Wu | H01R 12/75 |
| 9,935,393 | B2 * | 4/2018 | Tada | H01R 12/724 |
| 9,960,522 | B2 * | 5/2018 | Tada | H01R 12/707 |
| 2010/0255722 | A1 * | 10/2010 | Sander | H01R 13/521 439/587 |
| 2015/0295362 | A1 * | 10/2015 | Tziviskos | H01R 13/6581 439/607.01 |

* cited by examiner

*Primary Examiner* — James Harvey
*Assistant Examiner* — Oscar Jimenez
(74) *Attorney, Agent, or Firm* — Cheng-Ju Chiang

(57) ABSTRACT

An electrical connector includes an insulating housing, a plurality of conductive terminals fastened to the insulating housing, and a shielding element surrounding the insulating housing. The insulating housing has at least one docking surface. Each of the plurality of the conductive terminals has an extending portion. A surface of the extending portion of each of the plurality of the conductive terminals forms an insulation layer. The shielding element has a base body. At least one portion of a front surface of the base body protrudes frontward to form at least one sealing board attached to a rear of the at least one docking surface. The insulation layer of the extending portion of each of the plurality of the conductive terminals is exposed to the at least one docking surface, and is adjacent to and projects beyond a front surface of the at least one sealing board.

18 Claims, 7 Drawing Sheets

ELECTRICAL CONNECTOR

BACKGROUND OF THE INVENTION

1. Field of the Invention

The present invention generally relates to a connector, and more particularly to an electrical connector.

2. The Related Art

With the continuous developments of electronic products, a variety of the electronic products are connected with peripheral devices more and more frequently. A way of connecting each of the electronic products with one of the peripheral devices by a connector is a common connecting way.

Referring to FIG. 6 and FIG. 7, a conventional electrical connector 100' includes an insulating housing 10', two groups of conductive terminals 20' and a shielding element 30'. The insulating housing 10' includes a main portion 11', a first tongue portion 12' protruded frontward from a front surface of the main portion 11', and a second tongue portion 13' protruded frontward from a front surface of the first tongue portion 12'. The two groups of conductive terminals 20' are fastened in the insulating housing 10'. Front ends of one group of the conductive terminals 20' are exposed to a top surface of the second tongue portion 13' through the front surface of the first tongue portion 12' and arranged transversely. Front ends of the other group of the conductive terminals 20' are exposed to a bottom surface of the second tongue portion 13' through the front surface of the first tongue portion 12' and arranged transversely. The front ends of the two groups of the conductive terminals 20' exposed to the top surface and the bottom surface of the second tongue portion 13' are defined as exposing portions. Rear ends of the two groups of the conductive terminals 20' project beyond a rear surface of the main portion 11'.

The shielding element 30' is formed by a metal injection molding (MIM) technology. The shielding element 30' has a base portion 31'. The base portion 31' opens a receiving chamber 32' penetrating through a front surface and a rear surface of the base portion 31'. Two opposite sides of a front surface of the base portion 31' protrude frontward to form two side boards 33'. An upper portion and a lower portion of the front surface of the base portion 31' protrude frontward to form two docking boards 34' connecting with top surfaces and bottom surfaces of the two side boards 33', respectively. The main portion 11' is fastened in the receiving chamber 32'. The first tongue portion 12' and the second tongue portion 13' are received between the two side boards 33'. The two docking boards 34' are covered to a top surface and a bottom surface of the first tongue portion 12', respectively. Front surfaces of the two docking boards 34' and the first tongue portion 12' are flush.

However, after the conventional electrical connector 100' is docked with a docking connector frequently, metal scraps (not shown) are easily produced from the two docking boards 34', in addition, front ends of the two docking boards 34' are near to the exposing portions of the two groups of the conductive terminals 20', when the metal scraps are fallen off on the exposing portions of the conductive terminals 20', the conductive terminals 20' are easily caused to be electrically connected with the two docking boards 34', so that the conventional electrical connector 100' causes a short circuit.

SUMMARY OF THE INVENTION

An object of the present invention is to provide an electrical connector adapted for being interconnected with a docking connector. The electrical connector includes an insulating housing, a plurality of conductive terminals and a shielding element. The insulating housing includes a main portion, and a tongue portion fastened to a front end of the main portion. The tongue portion has a first docking portion, and a second docking portion protruded frontward from a middle of a front surface of the first docking portion. The tongue portion opens a plurality of terminal grooves arranged in two rows along an up-down direction. The terminal grooves are transversely arranged in each row. The two rows of the plurality of the terminal grooves penetrate through an upper portion and a lower portion of the first docking portion along a longitudinal direction, and a top surface and a bottom surface of the second docking portion along the up-down direction. The plurality of conductive terminals are fastened to the insulating housing and arranged in two rows. Each of the plurality of the conductive terminals has a fastening portion, an extending portion connected with a front end of the fastening portion, and a contact portion connected with a front end of the extending portion. A surface of the extending portion of each of the plurality of the conductive terminals forms an insulation layer. The fastening portions of the plurality of the conductive terminals are fastened in the main portion. Front ends of the extending portions and the contact portions of the two rows of the plurality of the conductive terminals pass through the two rows of the plurality of the terminal grooves and are exposed to the top surface and the bottom surface of the second docking portion. The shielding element is formed by a metal injection molding technology. The shielding element surrounds the insulating housing. The shielding element has a base body. Two opposite sides of a front surface of the base body extend frontward to form two side boards spaced from each other. An upper portion and a lower portion of the front surface of the base body protrude frontward to form two sealing boards. The two sealing boards are attached to a top surface and a bottom surface of the first docking portion. The first docking portion is surrounded among the two side boards and the two sealing boards. A front surface of the second docking portion is flush with front surfaces of the two side boards. The insulation layers of the extending portions of the two rows of the plurality of the conductive terminals are exposed to the top surface and the bottom surface of the second docking portion respectively, and are adjacent to and project beyond front surfaces of the two sealing boards respectively.

Another object of the present invention is to provide an electrical connector adapted for being interconnected with a docking connector. The electrical connector includes an insulating housing, a plurality of conductive terminals and a shielding element. The insulating housing has at least one docking surface for being docked with the docking connector. The insulating housing includes a main portion, and a tongue portion fastened to a front end of the main portion. The tongue portion has a first docking portion, and a second docking portion protruded frontward from a middle of a front surface of the first docking portion. The plurality of conductive terminals are fastened to the insulating housing and transversely arranged along the at least one docking surface. Each of the plurality of the conductive terminals has a fastening portion, an extending portion connected with a front end of the fastening portion, and a contact portion connected with a front end of the extending portion. A surface of the extending portion of each of the plurality of the conductive terminals forms an insulation layer. The fastening portions of the plurality of the conductive terminals are fastened in the main portion. Front ends of the extending portions and the contact portions of the plurality of the conductive terminals are exposed to a top surface and a bottom surface of the second docking portion. The shielding element is formed by a metal injection molding technology. The shielding element surrounds the insulating housing. The shielding element has a base body. Two opposite sides of a front surface of the base body extend frontward to form two side boards spaced from each other. At least one portion of the front surface of the base body protrudes frontward to form at least one sealing board connected with rear ends of the two side boards connecting with the base body. The at least one sealing board is attached to a rear of the at least one docking surface. The first docking portion is surrounded among the two side boards and the at least one sealing board. A front surface of the second docking portion is flush with front surfaces of the two side boards. The insulation layer of the extending portion of each of the plurality of the conductive terminals is exposed to the at least one docking surface, and is adjacent to and projects beyond a front surface of the at least one sealing board.

As described above, front ends of the extending portions of the plurality of the conductive terminals are exposed to at least one docking surface of the insulating housing, a surface of the front end of the extending portion of each of the plurality of the conductive terminals exposed out of the insulating housing, and adjacent to and projecting beyond the front surface of the at least one sealing board is coated with a layer of the insulation ink by a pad printing technology to form the insulation layer, after the electrical connector is interconnected with the docking connector frequently, metal scraps are produced from the at least one sealing board on account of the friction between the at least one sealing board and the docking connector, the metal scraps will be fallen off on the insulation layers of the plurality of the conductive terminals of the electrical connector, so that the metal scraps will be without connecting each of the plurality of the conductive terminals with the shielding element for isolating each of the plurality of the conductive terminals from the shielding element, and the metal scraps will be without connecting the plurality of the conductive terminals for isolating one of the plurality of the conductive terminals from the other conductive terminals. As a result, a short circuit of the electrical connector is prevented from being caused by the metal scraps.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
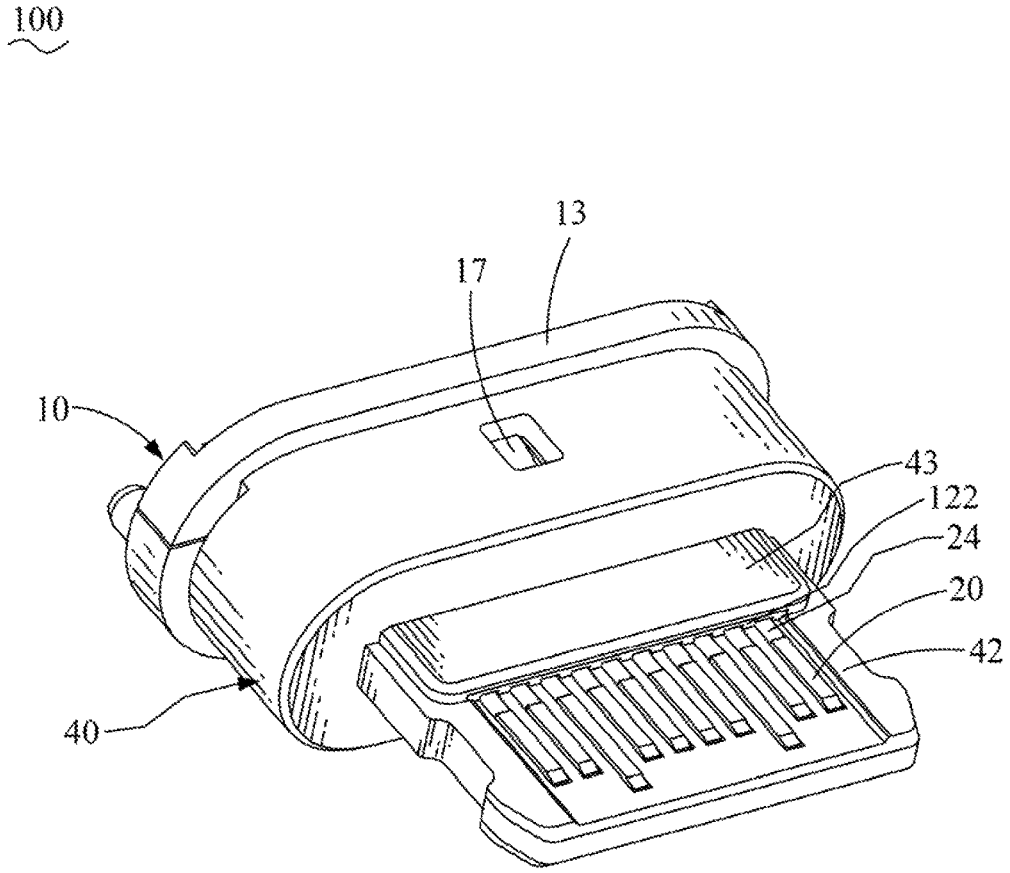
FIG. 1 is a perspective view of an electrical connector in accordance with the present invention.
Figure 2:
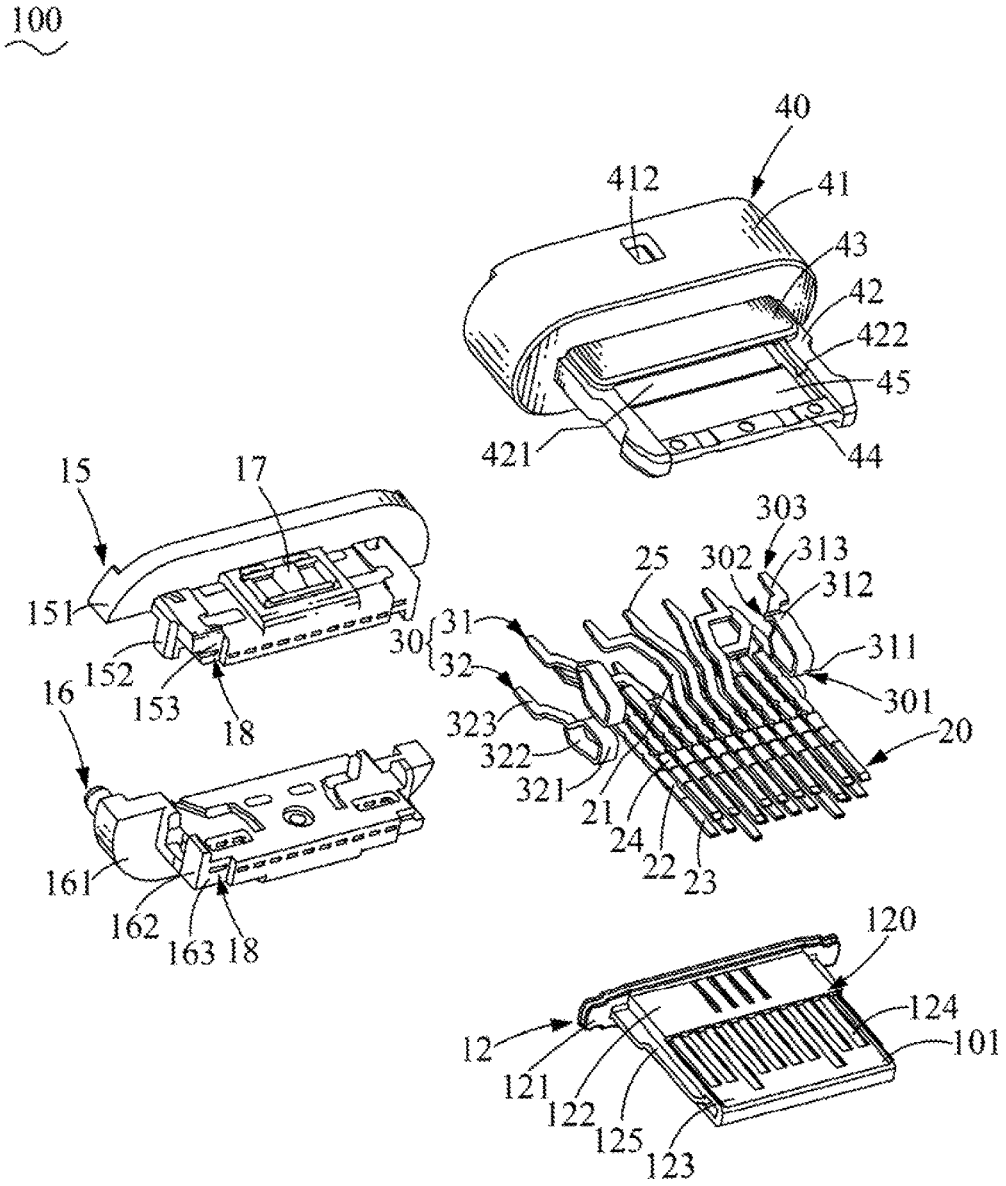
FIG. 2 is an exploded view of the electrical connector of FIG. 1.
Figure 3:
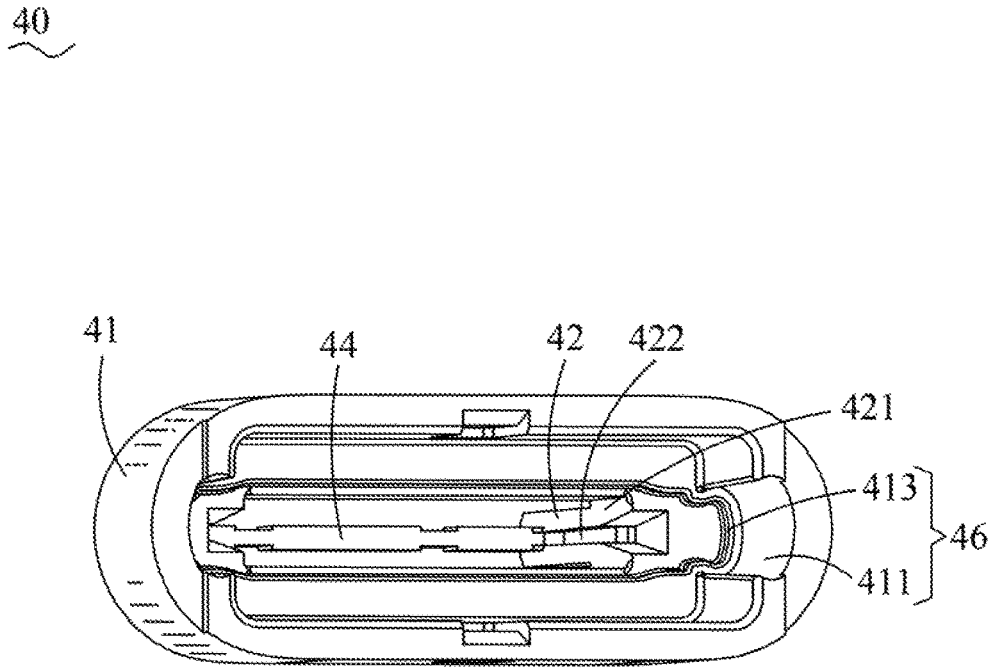
FIG. 3 is a perspective view of a shielding element of the electrical connector of FIG. 2.
Figure 4:
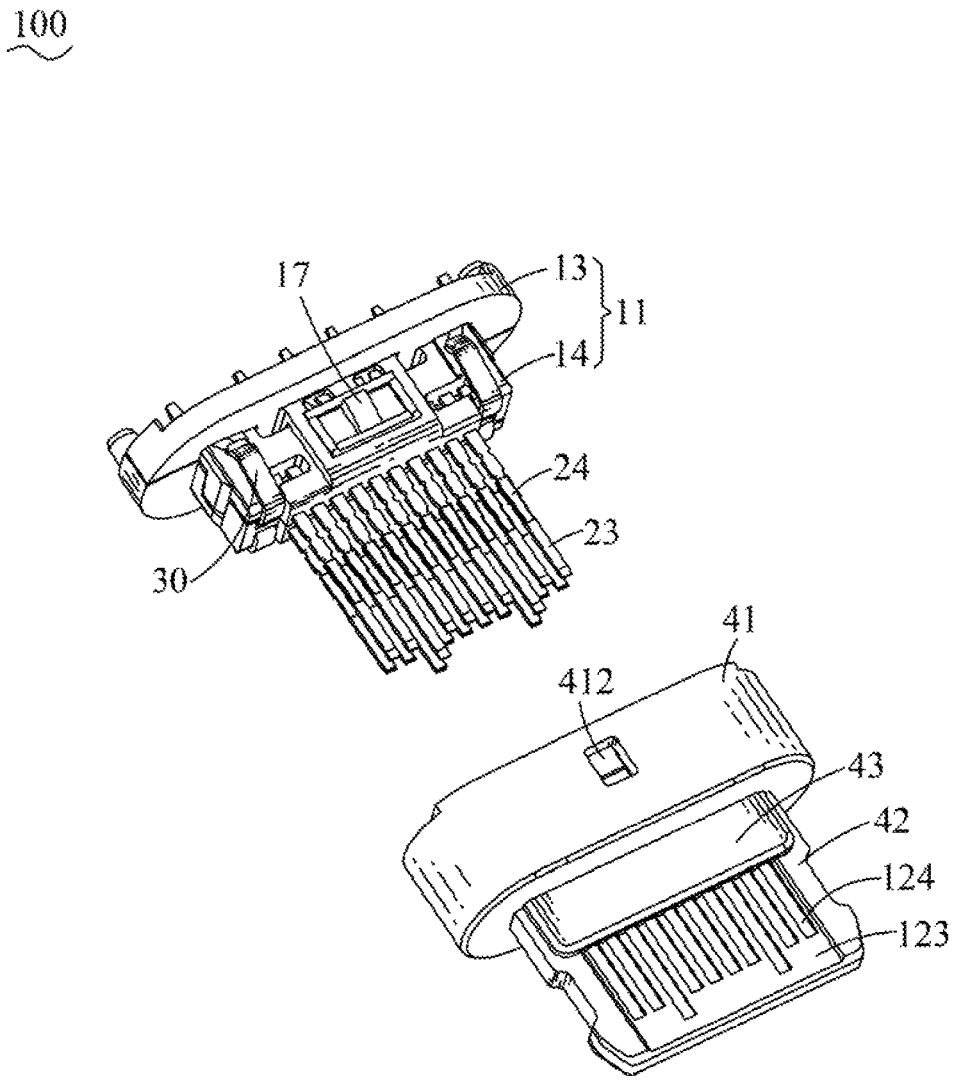
FIG. 4 is a partially exploded view of the electrical connector of FIG. 1.
Figure 5:
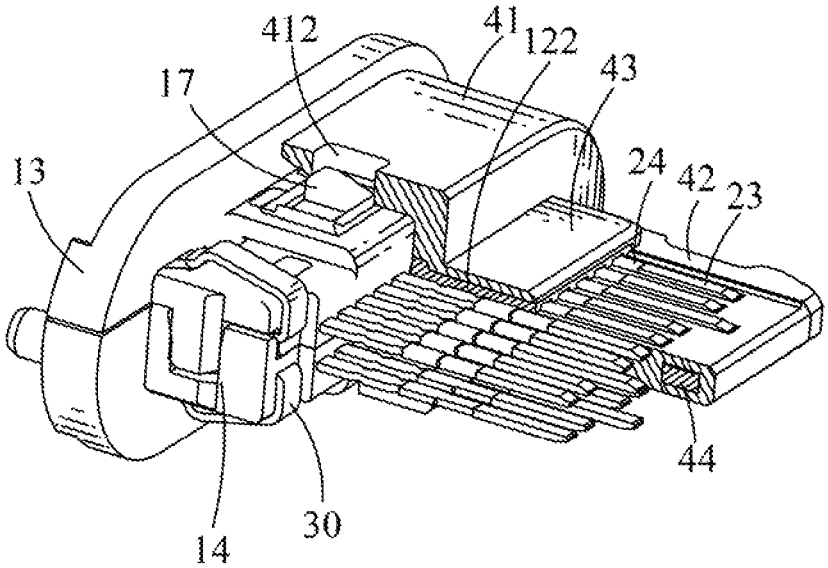
FIG. 5 is a partially sectional view of the electrical connector of FIG. 1.
Figure 6:
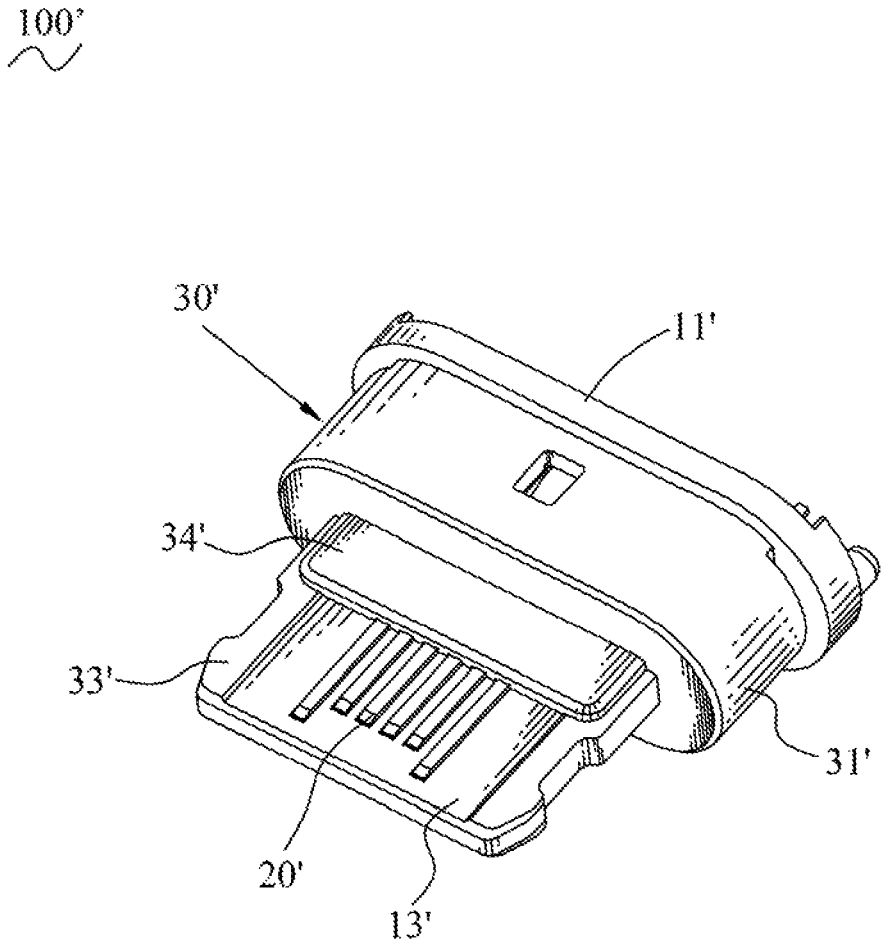
FIG. 6 (Prior Art)
FIG. 6 is a perspective view of a conventional electrical connector in prior art.
Figure 7:
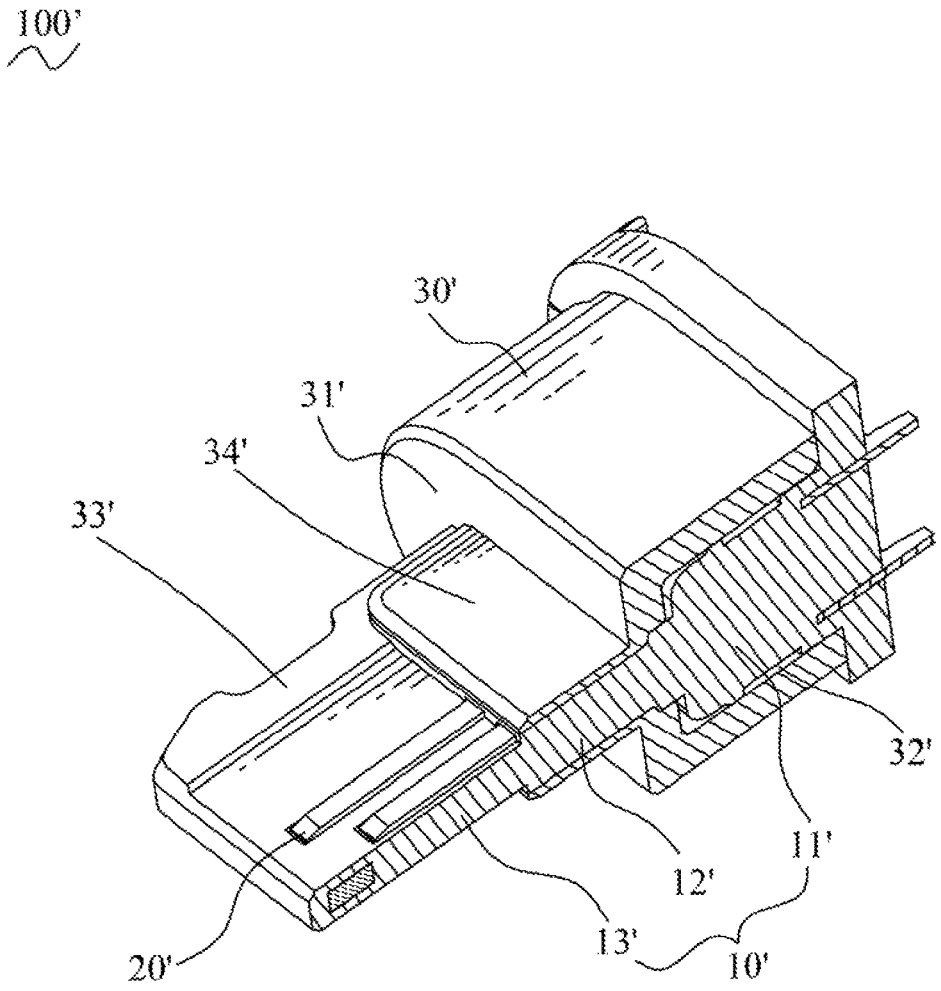
FIG. 7 (Prior Art)
FIG. 7 is a sectional view of the conventional electrical connector of FIG. 6.

With reference to FIG. 1 and FIG. 2, an electrical connector 100 in accordance with the present invention is shown. The electrical connector 100 adapted for being interconnected with a docking connector (not shown), includes an insulating housing 10, a plurality of conductive terminals 20, at least one ground terminal 30 and a shielding element 40.

Referring to FIG. 1 to FIG. 4, the insulating housing 10 includes a main portion 11 and a tongue portion 12 fastened to a front end of the main portion 11. A direction of the docking connector being inserted into the electrical connector 100 is defined as a front-to-rear direction, namely a longitudinal direction. Correspondingly, a transverse direction is defined as a direction perpendicular to the longitudinal direction. The main portion 11 includes a base portion 13, and a connecting portion 14 protruded frontward from a middle of a front surface of the base portion 13. Middles of a top surface and a bottom surface of the connecting portion 14 protrude oppositely to form two buckling blocks 17. Specifically, the main portion 11 includes an upper dielectric body 15 and a lower dielectric body 16 which are matched with each other and assembled together. The upper dielectric body 15 has an upper base portion 151, and an upper connecting portion 152 protruded frontward from a lower portion of a front surface of the upper base portion 151. Two opposite sides of a top surface of the upper connecting portion 152 are recessed inward to form two upper lacking grooves 153 penetrating through two opposite sides of a front surface of the upper connecting portion 152.

The lower dielectric body 16 has a lower base portion 161, and a lower connecting portion 162 protruded frontward from an upper portion of a front surface of the lower base portion 161. Two opposite sides of a bottom surface of the lower connecting portion 162 are recessed inward to form two lower lacking grooves 163 penetrating through two opposite sides of a front surface of the lower connecting portion 162. The upper base portion 151 and the lower base portion 161 are matched with each other. The upper connecting portion 152 and the lower connecting portion 162 are matched with each other. At least one portion of the top surface of the upper connecting portion 152 and the bottom surface of the lower connecting portion 162 are recessed inward to form at least one lacking groove 18 penetrating through at least one portion of the front surface of the upper connecting portion 152 and the front surface of the lower connecting portion 162.

Referring to FIG. 1 and FIG. 2, the tongue portion 12 has a limiting portion 121, and a docking portion 120 protruded frontward from a middle of a front surface of the limiting portion 121. The docking portion 120 has a first docking portion 122 protruded frontward from the middle of the front surface of the limiting portion 121, and a second docking portion 123 protruded frontward from a middle of a front surface of the first docking portion 122. The docking portion 120 of the tongue portion 12 of the insulating housing 10 has at least one docking surface 101 for being docked with the docking connector. The tongue portion 12 opens a plurality of terminal grooves 124 extending and penetrating through a rear surface of the tongue portion 12 along the longitudinal direction, and penetrating through a front of the at least one docking surface 101 along a vertical direction. The vertical direction is defined as a direction perpendicular to both the longitudinal direction and the transverse direction. The plurality of the terminal grooves 124 are transversely arranged along the at least one docking surface 101.

The plurality of the terminal grooves 124 are arranged in two rows along an up-down direction perpendicular to both the longitudinal direction and the transverse direction. The insulating housing 10 has two opposite docking surfaces 101. A top surface and a bottom surface of the docking portion 120 are defined as the two opposite docking surfaces 101. The two rows of the plurality of the terminal grooves 124 extend and penetrate through the rear surface of the tongue portion 12 along the longitudinal direction, and penetrate through the fronts of the two opposite docking surfaces 101 along the vertical direction. The terminal grooves 124 are transversely arranged in each row. The two rows of the plurality of the terminal grooves 124 penetrating through an upper portion and a lower portion of a rear surface of the limiting portion 121, and an upper portion and a lower portion of the first docking portion 122 along the longitudinal direction, and a top surface and a bottom surface of the second docking portion 123 along the up-down direction.

The two rows of the plurality of the terminal grooves 124 include an upper row of the terminal grooves 124, and a lower row of the terminal grooves 124 located under the upper row of the terminal grooves 124. The upper row of the terminal grooves 124 penetrate through the upper portion of the rear surface of the limiting portion 121 and the upper portion of the first docking portion 122 along the longitudinal direction, and penetrate through the top surface of the second docking portion 123 along the vertical direction. The lower row of the terminal grooves 124 penetrate through the lower portion of the rear surface of the limiting portion 121 and the lower portion of the first docking portion 122 along the longitudinal direction, and penetrate through the bottom surface of the second docking portion 123 along the vertical direction. Front ends of the upper row of the terminal grooves 124 penetrate through the top surface of the second docking portion 123 and are arranged transversely. Front ends of the lower row of the terminal grooves 124 penetrate through the bottom surface of the second docking portion 123 and are arranged transversely. Two opposite sides of the front surface of the limiting portion 121 protrude frontward to form two limiting ribs 125. Rear ends of the two limiting ribs 125 are connected with two opposite side surfaces of the first docking portion 122, respectively. Front ends of the two limiting ribs 125 are connected with two opposite side surfaces of the second docking portion 123, respectively.

Referring to FIG. 1 to FIG. 5, the plurality of the conductive terminals 20 and the at least one ground terminal 30 are fastened to the base portion 13 and the connecting portion 14 of the main portion 11 of the insulating housing 10 and arranged in two rows. The conductive terminals 20 are transversely arranged in each row. And the plurality of the conductive terminals 20 are transversely arranged along the at least one docking surface 101. Front ends of the plurality of the conductive terminals 20 and the at least one ground terminal 30 project beyond a front surface of the main portion 11 and are exposed out of the tongue portion 12. The front ends of the plurality of the conductive terminals 20 and the at least one ground terminal 30 project beyond a front surface of the connecting portion 14 of the insulating housing 10. Rear ends of the plurality of the conductive terminals 20 and the at least one ground terminal 30 project beyond a rear surface of the insulating housing 10. The rear ends of the plurality of the conductive terminals 20 and the at least one ground terminal 30 project beyond a rear surface of the main portion 11. The rear ends of the plurality of the conductive terminals 20 and the at least one ground terminal 30 project beyond a rear surface of the base portion 13.

The plurality of the conductive terminals 20 include an upper row of the conductive terminals 20 and a lower row of the conductive terminals 20. Each of the plurality of the conductive terminals 20 has a fastening portion 21, an extending portion 22 connected with a front end of the fastening portion 21, a contact portion 23 connected with a front end of the extending portion 22, and a soldering foot 25 connected with a rear end of the fastening portion 21. Rear ends of the upper row of the conductive terminals 20 and the lower row of the conductive terminals 20 project beyond the rear surface of the insulating housing 10. Front ends of the upper row of the conductive terminals 20 pass through the upper row of the terminal grooves 124 and are exposed to one of the two opposite docking surfaces 101. Front ends of the lower row of the conductive terminals 20 pass through the lower row of the terminal grooves 124 and are exposed to the other docking surface 101.

The fastening portions 21 of the plurality of the conductive terminals 20 are integrally molded in and fastened in the main portion 11 of the insulating housing 10. The extending portions 22 of the plurality of the conductive terminals 20 are received in the terminal grooves 124 and exposed out of the insulating housing 10 through the terminal grooves 124. A surface of the extending portion 22 of each of the plurality of the conductive terminals 20 is coated with a layer of insulation ink by a pad printing technology to form an insulation layer 24.

Specifically, the upper row of the conductive terminals 20 are integrally molded to the upper dielectric body 15 and arranged transversely. The fastening portions 21 of the upper row of the conductive terminals 20 are integrally molded in the upper dielectric body 15. The extending portions 22 and the contact portions 23 of the upper row of the conductive terminals 20 project beyond the front surface of the upper connecting portion 152. The soldering feet 25 of the upper row of the conductive terminals 20 project beyond a rear surface of the upper base portion 151. The lower row of the conductive terminals 20 are integrally molded to the lower dielectric body 16 and arranged transversely. The fastening portions 21 of the lower row of the conductive terminals 20 are integrally molded in the lower dielectric body 16. The extending portions 22 and the contact portions 23 of the lower row of the conductive terminals 20 project beyond the front surface of the lower connecting portion 162. The soldering feet 25 of the lower row of the conductive terminals 20 project beyond a rear surface of the lower base portion 161.

Referring to FIG. 2 to FIG. 5, the at least one ground terminal 30 has a fixing portion 301, a touching portion 302 connected with one end of the fixing portion 301, and a soldering portion 303 connected with the other end of the fixing portion 301. Preferably, the at least one ground terminal 30 includes two upper ground terminals 31 and two lower ground terminals 32. The two upper ground terminals 31 have two substantially U-shaped upper fixing portions 311, two upper touching portions 312 slantwise extended rearward and upward, and then arched downward from tops of front ends of the two upper fixing portions 311, and two upper soldering portions 313 slantwise extended rearward and oppositely, and then bent rearward from tops of rear ends of the two upper fixing portions 311. The two upper touching portions 312 are located above the two upper fixing portions 311, respectively. Tail ends of the two upper touching portions 312 approach to root portions of the two upper soldering portions 313, respectively. The two lower ground terminals 32 have two substantially inverted U-shaped lower fixing portions 321, two lower touching portions 322 slantwise extended rearward and downward, and then arched upward from bottoms of front ends of the two lower fixing portions 321, and two lower soldering portions 323 slantwise extended rearward and oppositely, and then bent rearward from bottoms of rear ends of the two lower fixing portions 321. The two lower touching portions 322 are located under the two lower fixing portions 321, respectively. Tail ends of the two lower touching portions 322 approach to root portions of the two lower soldering portions 323, respectively.

The at least one ground terminal 30 is integrally molded to at least one of the upper dielectric body 15 and the lower dielectric body 16. A front end of the fixing portion 301 and the touching portion 302 of the at least one ground terminal 30 are fastened in the at least one lacking groove 18. The two upper ground terminals 31 are integrally molded to the upper dielectric body 15. The upper row of the conductive terminals 20 are located between the two upper ground terminals 31. Rear ends and middles of the upper fixing portions 311 and front ends of the upper soldering portions 313 of the two upper ground terminals 31 are molded in the upper dielectric body 15. Front ends of the upper fixing portions 311 and the upper touching portions 312 of the two upper ground terminals 31 are fastened in the two upper lacking grooves 153, respectively. Rear ends of the upper soldering portions 313 of the two upper ground terminals 31 project beyond the rear surface of the upper base portion 151. The upper touching portions 312 of the two upper ground terminals 31 project beyond a top surface of the upper connecting portion 152.

The two lower ground terminals 32 are integrally molded to the lower dielectric body 16. The lower row of the conductive terminals 20 are located between the two lower ground terminals 32. Rear ends and middles of the lower fixing portions 321 and front ends of the lower soldering portions 323 of the two lower ground terminals 32 are molded in the lower dielectric body 16. Front ends of the lower fixing portions 321 and the lower touching portions 322 of the two lower ground terminals 32 are fastened in the two lower lacking grooves 163. Rear ends of the lower soldering portions 323 of the two lower ground terminals 32 project beyond the rear surface of the lower base portion 161. The lower touching portions 322 of the two lower ground terminals 32 project beyond the bottom surface of the lower connecting portion 162.

Referring to FIG. 2 to FIG. 5, the shielding element 40 is formed by a metal injection molding (MIM) technology. The shielding element 40 surround the insulating housing 10. The shielding element 40 has a base body 41. The base body 41 opens a receiving chamber 46 penetrating through a front surface and a rear surface of the base body 41. The receiving chamber 46 includes a first receiving chamber 411 and a second receiving chamber 413. The base body 41 opens the first receiving chamber 411 passing through a rear surface of the base body 41. A front wall of the first receiving chamber 411 opens the second receiving chamber 413 passing through the front surface of the base body 41. The second receiving chamber 413 is located in front of and communicated with the first receiving chamber 411. Two opposite sides of the front surface of the base body 41 extend frontward to form two side boards 42 spaced from each other. At least one portion of the front surface of the base body 41 protrudes frontward to form at least one sealing board 43 connected with rear ends of the two side boards 42 connecting with the base body 41. An upper portion and a lower portion of the front surface of the base body 41 protrude frontward to form two sealing boards 43 connected with the rear ends of the two side boards 42 connecting with the base body 41.

Specifically, a front of the receiving chamber 46 is located between the two side boards 42. The second receiving chamber 413 of the receiving chamber 46 is located between the two side boards 42. A third receiving chamber 421 is surrounded among the two side boards 42 and the at least one sealing board 43, and communicated with the first receiving chamber 411. The two sealing boards 43 are connected with upper portions and lower portions of the rear ends of the two side boards 42 connecting with the base body 41, so that the third receiving chamber 421 is surrounded among the two side boards 42 and the two sealing boards 43, and communicated with the first receiving chamber 411. The shielding element 40 further has a connecting board 44 connected between front ends of the two side boards 42. An opening 45 is formed between the front ends of the two side boards 42 projecting beyond front surfaces of the two sealing boards 43. Middles of two facing surfaces of the two side boards 42 are recessed oppositely to form two limiting slots 422 extending longitudinally. The two limiting slots 422 are corresponding to the two limiting ribs 125, respectively. Middles of a top and a bottom of the base body 41 open two buckling grooves 412 communicated with the first receiving chamber 411.

The shielding element 40 is integrally molded to the tongue portion 12. The limiting portion 121 is accommodated in the second receiving chamber 413. The first docking portion 122 is accommodated in the third receiving chamber 421 surrounded among the two side boards 42 and the at least one sealing board 43. The first docking portion 122 is accommodated in the third receiving chamber 421 surrounded among the two side boards 42 and the two sealing boards 43. The second docking portion 123 is received in the opening 45. The connecting board 44 is molded in a front end of the second docking portion 123. The two limiting ribs 125 are limited in the two limiting slots 422, respectively. The at least one sealing board 43 is attached to a rear of the at least one docking surface 101. A front surface of the second docking portion 123 is flush with front surfaces of the two side boards 42. The two sealing boards 43 are attached to rears of the two opposite docking surfaces 101. The two sealing boards 43 are attached to a top surface and a bottom surface of the first docking portion 122. A front surface of the first docking portion 122 is flush with front surfaces of the two sealing boards 43.

Referring to FIG. 1 to FIG. 5, when the electrical connector 100 is assembled, the main portion 11, the plurality of the conductive terminals 20 and the at least one ground terminal 30 are assembled to the shielding element 40 to which the tongue portion 12 is fastened. The base portion 13 of the main portion 11 covers and seals a rear end of the shielding element 40. A front of the main portion 11 is received in the first receiving chamber 411. The tongue portion 12 is fastened to the front of the main portion 11. The connecting portion 14 is received in the first receiving chamber 411. The two buckling blocks 17 are buckled in the two buckling grooves 412, respectively. A free end of the touching portion 302 of the at least one ground terminal 30 abuts against an inner surface of a wall of the first receiving chamber 411 of the receiving chamber 46. Free ends of the upper touching portions 312 of the two upper ground terminals 31 abut against an inner surface of a top wall of the first receiving chamber 411 of the receiving chamber 46. Free ends of the lower touching portions 322 of the two lower ground terminals 32 abut against an inner surface of a bottom wall of the first receiving chamber 411 of the receiving chamber 46.

The free ends of the upper touching portions 312 of the two upper ground terminals 31 abut against an inner surface of a top wall of the first receiving chamber 411. Free ends of the lower touching portions 322 of the two lower ground terminals 32 abut against an inner surface of a bottom wall of the first receiving chamber 411. A front surface of the base portion 13 abuts against the rear surface of the base body 41. The upper dielectric body 15 with the upper row of the conductive terminals 20 and the two upper ground terminals 31 being integrally molded thereto, and the lower dielectric body 16 with the lower row of the conductive terminals 20 and the two lower ground terminals 32 being molded thereto are assembled together. The upper base portion 151 and the lower base portion 161 are assembled into the base portion 13. The upper connecting portion 152 and the lower connecting portion 162 are assembled into the connecting portion 14.

The front ends of the plurality of the conductive terminals 20 are exposed out of the shielding element 40 through the opening 45. The front ends of the extending portions 22 of the plurality of the conductive terminals 20 pass through the plurality of the terminal grooves 124 and are exposed to the at least one docking surface 101 of the insulating housing 10. The front ends of the extending portions 22 and the contact portions 23 of the upper row and the lower row of the conductive terminals 20 pass through the upper row and the lower row of the terminal grooves 124 and are exposed to the two opposite docking surfaces 101 of the insulating housing 10. The front ends of the extending portions 22 and the contact portions 23 of the two rows of the plurality of the conductive terminals 20 pass through the two rows of the plurality of the terminal grooves 124 and are exposed to the top surface and the bottom surface of the second docking portion 123. The front ends of the extending portions 22 and the contact portions 23 of the upper row and the lower row of the plurality of the conductive terminals 20 pass through the upper row and the lower row of the terminal grooves 124 and are exposed to the top surface and the bottom surface of the second docking portion 123.

The surface of the extending portion 22 of each of the plurality of the conductive terminals 20 adjacent to and projecting beyond a front surface of the at least one sealing board 43 is coated with the layer of the insulation ink by the pad printing technology to form the insulation layer 24. A length of the insulation layer 24 of the extending portion 22 of each of the plurality of the conductive terminals 20 projecting beyond the front surface of the at least one sealing board 43 is approximately 0.25 mm. The insulation layer 24 of the extending portion 22 of each of the plurality of the conductive terminals 20 is exposed to the at least one docking surface 101, and is adjacent to and projects beyond the front surface of the at least one sealing board 43. A surface of the front end of the extending portion 22 of each of the plurality of the conductive terminals 20 exposed out of the insulating housing 10, and adjacent to and projecting beyond the front surface of the at least one sealing board 43 is coated with the layer of the insulation ink by the pad printing technology to form the insulation layer 24. A surface of a rear end of the extending portion 22 of each of the plurality of the conductive terminals 20 adjacent to the front surface of the at least one sealing board 43 is capable of being coated with the layer of the insulation ink by the pad printing technology to form the insulation layer 24 and being received in one of the terminal grooves 124 of the insulating housing 10.

Each of the surfaces of the extending portions 22 of the plurality of the conductive terminals 20 adjacent to and projecting beyond the front surfaces of the two sealing boards 43 is coated with the layer of the insulation ink by the pad printing technology to form the insulation layer 24. The length of the insulation layer 24 of each of the extending portions 22 of the two rows of the plurality of the conductive terminals 20 projecting beyond the front surfaces of the two sealing boards 43 respectively is approximately 0.25 mm. The insulation layers 24 of the extending portions 22 of the two rows of the plurality of the conductive terminals 20 are exposed to the top surface and the bottom surface of the second docking portion 123 respectively, and are adjacent to and project beyond the front surfaces of the two sealing boards 43 respectively. Each of the surfaces of the front ends of the extending portions 22 of the two rows of the plurality of the conductive terminals 20 exposed out of the insulating housing 10, and adjacent to and projecting beyond the front surfaces of the two sealing boards 43 respectively is coated with the layer of the insulation ink by the pad printing technology to form the insulation layer 24. Each of the surfaces of the rear ends of the extending portions 22 of the two rows of the plurality of the conductive terminals 20 adjacent to the front surfaces of the two sealing boards 43 respectively is capable of being coated with the layer of the insulation ink by the pad printing technology to form the insulation layer 24 and being received in the one of the plurality of terminal grooves 124 of the insulating housing 10.

After the electrical connector 100 is interconnected with the docking connector frequently, metal scraps are produced from the at least one sealing board 43 on account of a friction between the at least one sealing board 43 and the docking connector, the metal scraps will be fallen off on the insulation layers 24 of the plurality of the conductive terminals 20 of the electrical connector 100, so that the metal scraps will be without connecting each of the plurality of the conductive terminals 20 with the shielding element 40 for isolating each of the plurality of the conductive terminals 20 from the shielding element 40, and the metal scraps will be without connecting the plurality of the conductive terminals 20 for isolating one of the plurality of the conductive terminals 20 from the other conductive terminals 20.

As described above, the front ends of the extending portions 22 of the plurality of the conductive terminals 20 are exposed to the at least one docking surface 101 of the insulating housing 10, the surface of the front end of the extending portion 22 of each of the plurality of the conductive terminals 20 exposed out of the insulating housing 10, and adjacent to and projecting beyond the front surface of the at least one sealing board 43 is coated with the layer of the insulation ink by the pad printing technology to form the insulation layer 24, after the electrical connector 100 is interconnected with the docking connector frequently, the metal scraps are produced from the at least one sealing board 43 on account of the friction between the at least one sealing board 43 and the docking connector, the metal scraps will be fallen off on the insulation layers 24 of the plurality of the conductive terminals 20 of the electrical connector 100, so that the metal scraps will be without connecting each of the plurality of the conductive terminals 20 with the shielding element 40 for isolating each of the plurality of the conductive terminals 20 from the shielding element 40, and the metal scraps will be without connecting the plurality of the conductive terminals 20 for isolating the one of the plurality of the conductive terminals 20 from the other conductive terminals 20. As a result, a short circuit of the electrical connector 100 is prevented from being caused by the metal scraps.

What is claimed is:

1. An electrical connector adapted for being interconnected with a docking connector, comprising:

an insulating housing including a main portion, and a tongue portion fastened to a front end of the main portion, the tongue portion having a first docking portion, and a second docking portion protruded frontward from a middle of a front surface of the first docking portion, the tongue portion opening a plurality of terminal grooves arranged in two rows along an up-down direction, the terminal grooves being transversely arranged in each row, the two rows of the plurality of the terminal grooves penetrating through an upper portion and a lower portion of the first docking portion along a longitudinal direction, and a top surface and a bottom surface of the second docking portion along the up-down direction;

a plurality of conductive terminals fastened to the insulating housing and arranged in two rows, each of the plurality of the conductive terminals having a fastening portion, an extending portion connected with a front end of the fastening portion, and a contact portion connected with a front end of the extending portion, a surface of the extending portion of each of the plurality of the conductive terminals forming an insulation layer, the fastening portions of the plurality of the conductive terminals being fastened in the main portion, front ends of the extending portions and the contact portions of the two rows of the plurality of the conductive terminals passing through the two rows of the plurality of the terminal grooves and being exposed to the top surface and the bottom surface of the second docking portion; and a shielding element formed by a metal injection molding technology, the shielding element surrounding the insulating housing, the shielding element having a base body, two opposite sides of a front surface of the base body extending frontward to form two side boards spaced from each other, an upper portion and a lower portion of the front surface of the base body protruding frontward to form two sealing boards, the two sealing boards being attached to a top surface and a bottom surface of the first docking portion, the first docking portion being surrounded among the two side boards and the two sealing boards, a front surface of the second docking portion being flush with front surfaces of the two side boards;

wherein the insulation layers of the extending portions of the two rows of the plurality of the conductive terminals are exposed to the top surface and the bottom surface of the second docking portion respectively, and are adjacent to and project beyond front surfaces of the two sealing boards respectively.

2. The electrical connector as claimed in claim 1, wherein each of the surfaces of the extending portions of the plurality of the conductive terminals adjacent to and projecting beyond the front surfaces of the two sealing boards is coated with a layer of insulation ink by a pad printing technology to form the insulation layer.

3. The electrical connector as claimed in claim 2, wherein each of surfaces of the front ends of the extending portions of the two rows of the plurality of the conductive terminals exposed out of the insulating housing, and adjacent to and projecting beyond the front surfaces of the two sealing boards respectively is coated with the layer of the insulation ink by the pad printing technology to form the insulation layer, each of surfaces of rear ends of the extending portions of the two rows of the plurality of the conductive terminals adjacent to the front surfaces of the two sealing boards respectively is capable of being coated with the layer of the insulation ink by the pad printing technology to form the insulation layer and being received in one of the plurality of terminal grooves.

4. The electrical connector as claimed in claim 1, wherein a length of the insulation layer of each of the extending portions of the two rows of the plurality of the conductive terminals projecting beyond the front surfaces of the two sealing boards respectively is approximately 0.25 mm.

5. The electrical connector as claimed in claim 1, wherein the two rows of the plurality of the terminal grooves include an upper row of the terminal grooves, and a lower row of the terminal grooves located under the upper row of the terminal grooves, the tongue portion has a limiting portion, and the first docking portion protruded frontward from a middle of a front surface of the limiting portion, the upper row of the terminal grooves penetrate through an upper portion of a rear surface of the limiting portion, the upper portion of the first docking portion and the top surface of the second docking portion, the lower row of the terminal grooves penetrate through a lower portion of the rear surface of the limiting portion, the lower portion of the first docking portion, and the bottom surface of the second docking portion, the plurality of the conductive terminals include an upper row of the conductive terminals and a lower row of the conductive terminals, front ends of the upper row of the conductive terminals pass through the upper row of the terminal grooves, front ends of the lower row of the conductive terminals pass through the lower row of the terminal grooves.

6. The electrical connector as claimed in claim 1, wherein the main portion includes a base portion, and a connecting portion protruded frontward from a middle of a front surface of the base portion, the main portion includes an upper dielectric body, and a lower dielectric body which are matched with each other and assembled together, the upper dielectric body has an upper base portion, and an upper connecting portion protruded frontward from a lower portion of a front surface of the upper base portion, the upper base portion and the lower base portion are assembled into the base portion, the upper connecting portion and the lower connecting portion are assembled into the connecting portion, the plurality of the conductive terminals are fastened to the base portion and the connecting portion of the main portion of the insulating housing, the conductive terminals are transversely arranged in each row.

7. The electrical connector as claimed in claim 6, wherein the tongue portion has a limiting portion, and the first docking portion protruded frontward from a middle of a front surface of the limiting portion, the base body opens a first receiving chamber passing through a rear surface of the base body, a front wall of the first receiving chamber opens a second receiving chamber passing through a front surface of the base body, the shielding element is integrally molded to the tongue portion, the base portion covers and seals a rear end of the shielding element, the connecting portion is received in the first receiving chamber, the limiting portion is accommodated in the second receiving chamber.

8. The electrical connector as claimed in claim 7, wherein the two sealing boards are connected with upper portions and lower portions of rear ends of the two side boards connecting with the base body, a third receiving chamber is surrounded among the two side boards and the two sealing boards, and communicated with the first receiving chamber, the first docking portion is accommodated in the third receiving chamber.

9. The electrical connector as claimed in claim 7, wherein middles of a top surface and a bottom surface of the connecting portion protrude oppositely to form two buckling blocks, middles of a top and a bottom of the base body open two buckling grooves communicated with the first receiving chamber, the two buckling blocks are buckled in the two buckling grooves, respectively.

10. The electrical connector as claimed in claim 7, wherein two opposite sides of the front surface of the limiting portion protrude frontward to form two limiting ribs, middles of two facing surfaces of the two side boards are recessed oppositely to form two limiting slots extending longitudinally, the two limiting ribs are limited in the two limiting slots, respectively.

11. The electrical connector as claimed in claim 7, wherein the shielding element further has a connecting board connected between front ends of the two side boards, an opening is formed between the front ends of the two side boards projecting beyond the front surfaces of the two sealing boards, the second docking portion is received in the opening, the connecting board is molded in a front end of the second docking portion.

12. The electrical connector as claimed in claim 7, further comprising at least one ground terminal which has a fixing portion, a touching portion connected with one end of the fixing portion, and a soldering portion connected with the other end of the fixing portion, at least one portion of a top surface of the upper connecting portion and a bottom surface of the lower connecting portion being recessed inward to form at least one lacking groove penetrating through at least one portion of a front surface of the upper connecting portion and a front surface of the lower connecting portion, a front end of the fixing portion and the touching portion of the at least one ground terminal being fastened in the at least one lacking groove, a free end of the touching portion of the at least one ground terminal abutting against an inner surface of a wall of the first receiving chamber.

13. The electrical connector as claimed in claim 12, wherein the at least one ground terminal includes two upper ground terminals and two lower ground terminals, the two upper ground terminals have two upper fixing portions, two upper touching portions slantwise extended rearward and upward, and then arched downward from tops of front ends of the two upper fixing portions, and two upper soldering portions slantwise extended rearward and oppositely, and then bent rearward from tops of rear ends of the two upper fixing portions, two opposite sides of the top surface of the upper connecting portion are recessed inward to form two upper lacking grooves penetrating through two opposite sides of the front surface of the upper connecting portion, the upper fixing portions of the two upper ground terminals are molded in the upper dielectric body, the upper touching portions of the two upper ground terminals are fastened in the two upper lacking grooves, respectively, the upper soldering portions of the two upper ground terminals project beyond a rear surface of the upper base portion, free ends of the upper touching portions of the two upper ground terminals abut against an inner surface of a top wall of the first receiving chamber.

14. The electrical connector as claimed in claim 13, wherein the two lower ground terminals have two lower fixing portions, two lower touching portions slantwise extended rearward and downward, and then arched upward from bottoms of front ends of the two lower fixing portions, and two lower soldering portions slantwise extended rearward and oppositely, and then bent rearward from bottoms of rear ends of the two lower fixing portions, the lower fixing portions of the two lower ground terminals are molded in the lower dielectric body, two opposite sides of the bottom surface of the lower connecting portion are recessed inward to form two lower lacking grooves penetrating through two opposite sides of the front surface of the lower connecting portion, the lower touching portions of the two lower ground terminals are fastened in the two lower lacking grooves, the lower soldering portions of the two lower ground terminals project beyond a rear surface of the lower base portion, free ends of the lower touching portions of the two lower ground terminals abut against an inner surface of a bottom wall of the first receiving chamber.

15. An electrical connector adapted for being interconnected with a docking connector, comprising:

an insulating housing having at least one docking surface for being docked with the docking connector, the insulating housing including a main portion, and a tongue portion fastened to a front end of the main portion, the tongue portion having a first docking portion, and a second docking portion protruded frontward from a middle of a front surface of the first docking portion;

a plurality of conductive terminals fastened to the insulating housing and transversely arranged along the at least one docking surface, each of the plurality of the conductive terminals having a fastening portion, an extending portion connected with a front end of the fastening portion, and a contact portion connected with a front end of the extending portion, a surface of the extending portion of each of the plurality of the conductive terminals forming an insulation layer, the fastening portions of the plurality of the conductive terminals being fastened in the main portion, front ends of the extending portions and the contact portions of the plurality of the conductive terminals being exposed to a top surface and a bottom surface of the second docking portion; and a shielding element formed by a metal injection molding technology, the shielding element surrounding the insulating housing, the shielding element having a base body, two opposite sides of a front surface of the base body extending frontward to form two side boards spaced from each other, at least one portion of the front surface of the base body protruding frontward to form at least one sealing board connected with rear ends of the two side boards connecting with the base body, the at least one sealing board being attached to a rear of the at least one docking surface, the first docking portion being surrounded among the two side boards and the at least one sealing board, a front surface of the second docking portion being flush with front surfaces of the two side boards;

wherein the insulation layer of the extending portion of each of the plurality of the conductive terminals is exposed to the at least one docking surface, and is adjacent to and projects beyond a front surface of the at least one sealing board.

16. The electrical connector as claimed in claim 15, wherein the surface of the extending portion of each of the plurality of the conductive terminals adjacent to and projecting beyond the front surface of the at least one sealing board is coated with a layer of the insulation ink by a pad printing technology to form the insulation layer.

17. The electrical connector as claimed in claim 16, wherein a surface of a front end of the extending portion of each of the plurality of the conductive terminals exposed out of the insulating housing, and adjacent to and projecting beyond the front surface of the at least one sealing board is coated with the layer of the insulation ink by the pad printing technology to form the insulation layer, a surface of a rear end of the extending portion of each of the plurality of the conductive terminals adjacent to the front surface of the at least one sealing board is capable of being coated with the layer of the insulation ink by the pad printing technology to form the insulation layer and being received in the insulating housing.

18. The electrical connector as claimed in claim 15, wherein a length of the insulation layer of the extending portion of each of the plurality of the conductive terminals projecting beyond the front surface of the at least one sealing board is approximately 0.25 mm.

* * * * *